United States Patent [19]

Dillarstone et al.

[11] 4,181,623

[45] Jan. 1, 1980

[54] CLEANING COMPOSITIONS

[75] Inventors: Alan Dillarstone, Bramhall; Alan Straw, Macclesfield, both of England

[73] Assignee: Colgate-Palmolive Company, New York, N.Y.

[21] Appl. No.: 886,982

[22] Filed: Mar. 15, 1978

[30] Foreign Application Priority Data

Mar. 15, 1977 [GB] United Kingdom ..... 10881/77

[51] Int. Cl.[2] ..... C11D 7/50; C11D 7/08

[52] U.S. Cl. ..... 252/143; 252/79.1; 252/79.3; 252/142; 252/170; 252/172; 252/DIG. 10; 134/3; 134/40

[58] Field of Search ..... 252/143, 142, 79.3, 252/79.1, DIG. 10, 170, 172; 134/3, 40

[56] References Cited

U.S. PATENT DOCUMENTS

| | | | |
|---|---|---|---|
| 2,558,013 | 6/1951 | St. Aubly et al. | 252/143 |
| 2,714,094 | 7/1955 | McNally | 252/DIG. 10 |
| 3,310,495 | 3/1967 | Masuda et al. | 252/79.3 |
| 3,696,043 | 10/1972 | Labange | 252/DIG. 10 |
| 3,876,468 | 4/1975 | Oba et al. | 252/DIG. 10 |
| 3,887,403 | 6/1975 | Coggins | 252/79.3 X |
| 4,009,115 | 2/1977 | Binns | 252/142 |

OTHER PUBLICATIONS

Bennett Formulary, vol. II, 1961, Chem. Pub. Co., p. 314.

*Primary Examiner*—Mayer Weinblatt

*Attorney, Agent, or Firm*—Richard N. Miller; Murray M. Grill; Herbert S. Sylvester

[57] ABSTRACT

A composition suitable for cleaning glass or glazed ceramic articles is described which comprises, by weight, 0.05% to 0.5% hydrofluroic acid or an acid salt thereof, a second water-soluble acid selected from the group consisting of 0.02% to 4% of acetic acid, hydroxy acetic acid, propionic acid and lactic acid and 0.05% to 0.8% of a non-oxidizing mineral acid other than hydrofluoric acid, 0.01 to 0.5% of a water-soluble anionic or nonionic organic detergent, 0% to 10% of a solvent selected from the group consisting of $C_1$–$C_4$ alkyl ethers of ethylene glycol, $C_1$–$C_4$ alcohols and $C_2$–$C_4$ ketones and the balance water. Such compositions reduce water spots and stains and leave a shiny finish.

11 Claims, No Drawings

CLEANING COMPOSITIONS

The present invention relates to cleaning compositions suitable for cleaning windows and other glass, and surfaces of glazed ceramic articles.

For convenience the term "glass" will be used herein to include not only glass itself but also such glazed surfaces.

Stains left by water and water droplets remaining and drying on glass are tightly adherent deposits, e.g. of calcium salts and silica, from soot, smoke, dust and the like. The deposits are so firmly bound to the glass that they cannot be readily removed by the use of abrasives. Water-soluble alkalis frequently found in ordinary tap water also stain glass by etching it, leaving a dull finish on the glass. These stains cannot be removed by the traditional alkaline cleaning solutions heretofore used for these purposes.

Hydrofluoric acid has been used for cleaning brickwork, stonework and the like, as well as for etching glass surfaces and removing coatings. However, the use of hydrofluoric acid for cleaning glass has been limited because of the danger of etching the glass.

According to the present invention a composition suitable for cleaning glass comprises a source of fluoride ion, organic and/or mineral acid, anionic and/or nonionic surfactant and water.

Although the fluoride ion responsible for removing carbonates and silicates present on glass is preferably provided by hydrofluoric acid, acid salts of hydrofluoric acid, such as ammonium bifluoride, are also effective. The amount of the compound serving as a source of fluoride ion present in the compositions will generally be in the range from 0.05% to 0.50%, preferably from 0.1% to 0.2% by weight.

Any compatible water-soluble organic acid (e.g., acetic, hydroxyacetic, propionic or lactic acid) or non-oxidizing mineral acid (e.g. orthophosphoric or sulphuric acid) having an equivalent weight greater than 20 and without the capacity to attack silica is effective in the compositions of the present invention to enhance removal of calcareous deposits. Acetic acid is the preferred acid. The acid will generally be present in an amount in the range from 0.02% to 4.0%, preferably from 0.1% to 0.5% by weight in the case of an organic acid, and from 0.05% to 0.8%, preferably from 0.1% to 0.4% by weight in the case of a mineral acid. Where acetic acid is employed, it is added in the form of white vinegar (20% acetic acid), and will generally be present in an amount in the range from 0.10% to 20% by weight, preferably from 0.5% to 2.0%.

The surfactant is present in the compositions in order to speed contact of the composition with greasy or oily surfaces and to aid in removal of deposits of grease, oil, dust and other forms of dirt. The surfactant will generally be present in an amount of at least 0.01%, e.g. from 0.01% to 0.50%, preferably from 0.05% to 0.20%, by weight.

The surfactant may be either anionic or nonionic. The anionic surfactants include those surface active water-soluble, detergent compounds which contain an organic hydrophobic group of 8 to 26 carbon atoms in the molecule group and an anionic solubilizing group. Typical examples of anionic solubilizing groups are sulphonate, sulphate, carboxylate, phosphonate and phosphate. Examples of anionic surfactants are soaps, such as the water-soluble salts of $C_8$–$C_{18}$ fatty acids or rosin acids, such as may be derived from fats, oils and waxes of animal, vegetable origin, e.g. the sodium soaps of tallow, grease, coconut oil, tall oil and mixtures thereof; and sulphated and sulphonated synthetic detergents, particularly those having from 8 to 26, preferably 12 to 22, carbon atoms in the molecule.

As examples of suitable sulfonated anionic detergents there may be cited the higher alkyl mononuclear aromatic sulphonates such as the higher alkyl benzene sulphonates containing from 10 to 16 carbon atoms in the alkyl group in a straight or branched chain, e.g. the sodium higher alkyl benzene sulphonates or higher alkyl toluene, xylene or phenol sulphonates, alkyl naphthalene sulphonate, ammonium diamyl naphthalene sulphonate and sodium dinonyl naphthalene sulphonate. In one preferred type of composition there is used a linear alkyl benzene sulphonate having a high content of 3- (or higher) phenyl isomers and a correspondingly low content (well below 50%) of 2- (or lower) phenyl isomers; in other words, the benzene ring is preferably attached in large part at the 3 or higher (e.g. 4, 5, 6 or 7) position of the alkyl group and the content of isomers in which the benzene ring is attached at the 2 or 1 position is correspondingly low. Particularly preferred materials are set forth in U.S. Pat. No. 3,320,174.

Other anionic detergents are olefin sulphonates, including long chain alkene sulphonates, long chain hydroxyalkane sulphonates and mixtures of alkenesulphonates and hydroxyalkanesulphonates. These olefin sulphonate detergents may be prepared, in known manner, by the reaction of sulphur trioxide with long chain olefins (of 8 to 25, preferably 12 to 21, carbon atoms) of the formula $RCH{=}CHR_1$, where R is alkyl and $R_1$ is alkyl or hydrogen, to produce a mixture of sultones and alkenesulphonic acids, which mixture is then treated to convert the sultones to sulphonates. Examples of other sulphate and sulphonate detergents are paraffin sulphonates, such as the reaction products of alpha olefins and bisulphites (e.g. sodium bisulphite), for instance, primary paraffin sulphonates of 10 to 20, preferably 15 to 20, carbon atoms, such as the primary paraffin sulphonates made by reacting long chain alpha olefins and bisulphites (e.g. sodium bisulphite) or paraffin sulphonates having the sulphonate groups distributed along the paraffin chain such as the products made by reacting a long chain paraffin with sulphur dioxide and oxygen under ultraviolet light followed by neutralization with sodium hydroxide or other suitable base (as in U.S. Pat. Nos. 2,503,280; 2,507,088; 3,260,741; 3,372,188 and German Pat. No. 735,096); sulphates of higher alcohols; salts of α-sulphofatty esters (e.g. of 10 to 20 carbon atoms, such as methyl α-sulphomyristate or α-sulphotallowate).

Examples of sulphates of $C_8$–$C_{18}$ alcohols are sodium lauryl sulphate and sodium tallow alcohol sulphate. Turkey Red Oil or other sulphated oils, or sulphates of mono- or di-glycerides of fatty acids (e.g., stearic monoglyceride monosulphate), $C_8$–$C_{18}$ alkyl poly (ethenoxy) ether sulphates having 1 to 5 ethenoxy groups per molecule, such as the sulphates of the condensation product of three moles of ethylene oxide and lauryl alcohol lauryl or other higher alkyl glyceryl ether sulphonates; and aromatic poly (ethenoxy) ether sulphates having 1 to 6 oxyethylene groups per molecule, such as the sulphate of the condensation products of four moles of ethylene oxide and nonyl phenol.

The suitable anionic detergents include also the $C_8$–$C_{18}$ acyl sarcosinates (e.g., sodium lauroylsarcosinate), the $C_8$–$C_{18}$ acyl esters (e.g., oleic acid ester) of isethionates, and the $C_8$–$C_{18}$ acyl N-methyl taurides (e.g., potassium N-methyl lauroyl- or oleyl tauride).

The cation of the water-soluble anionic detergent compounds may be ammonium, substituted ammonium (such as mono-, di- and triethanolamine), alkali metal (such as sodium and potassium) or alkaline earth metal (such as calcium and magnesium). Preferred anionic detergents are the salts of the higher alkyl benzene sulphonates, olefin sulphonates, the higher alkyl sulphates, and the higher fatty acid mono-glyceride sulphates.

Nonionic surfactants include those surface active detergent compounds which contain an organic hydrophobic group and a hydrophilic ethylene oxide group. Practically any hydrophobic compound having a carboxylate, hydroxyl, amido or amino with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

As examples of nonionic surface active agents which may be used are the condensation products of $C_6$–$C_{12}$ alkyl phenols with about 6 to about 30 ethylene oxide units, e.g., isoctyl phenol condensed with 6 moles of ethylene oxide; condensation products of $C_6$–$C_{12}$ alkyl thiophenols with 10 to 15 ethylene oxide units; condensation products of higher $C_8$–$C_{18}$ alcohols with about 5 to 30 moles of ethylene oxide, e.g., tridecyl alcohol with 11–15 moles of ethylene oxide; ethylene oxide addends of monoesters of hexahydric alcohols and $C_8$–$C_{18}$ alkanoic acids and inner ethers thereof, such as ethoxylated sorbitan monolaurate (20 EtO) and ethoxylated sorbitan monooleate (20 EtO); and the condensation products of polypropylene glycol with ethylene oxide having a molecular weight of from 1,000 to 15,000, in which the polyethylene oxide content may comprise 20% to 80% by weight.

Generally, the balance of the composition is water, but organic solvents, such as $C_1$–$C_4$ "Cellosolves" (mono- and di-$C_1$–$C_4$ alkyl ethers of ethylene glycol and derivatives thereof), $C_1$–$C_4$ alcohols and lower ketones containing 2 to 4 carbon atoms, can be used to improve the solubility of the surfactant in the composition. Solubility of the surfactant is of particular importance when the composition is to be packaged in pump bottles, squeeze bottles or aerosol containers, as the composition of the solution delivered to the surface to be cleaned should be the same for each application. A preferred solvent for this purpose is butyl "Cellosolve" (ethylene glycol monobutyl ether). The solvent is present in an amount in the range from 1% to 10% by weight of composition.

A preferred method of application of the cleaning compositions of the present invention is by spraying the composition onto the surface of the glass to be cleaned. Thus, pump bottles, squeeze bottles, or aerosol containers can be used for packaging the composition to provide convenient means of application.

In preparing the cleaning compositions of the present invention, any of the commercially available concentrations of hydrofluoric acid may be used, and the desired concentration achieved by addition of water. When reference is made herein to the concentration of hydrofluoric acid in the present composition, concentration of anhydrous hydrogen fluoride (HF) by weight is meant.

The following Examples illustrate the invention. In preparing the compositions, the ingredients may be added in any order.

EXAMPLE I

| | % by weight |
|---|---|
| Hydrofluoric acid (100% basis) | 0.2 |
| Sodium lauryl ether sulphate (3 EtO) | 0.07 |
| White vinegar (20% acetic acid) | 5.0 |
| Butyl "Cellosolve" | 8.0 |
| Water | q.s. |

The composition of Example I produced a demonstrable increase in clarity in a sample of old, weathered domestic window glass, while a conventional ammonia-based window cleaner could produce no benefit.

EXAMPLE II

| | % by weight |
|---|---|
| Ammonium bifluoride | 0.45 |
| Sodium lauryl sulphate | 0.05 |
| White vinegar (20% acetic acid) | 0.5 |
| Ethyl "Cellosolve" (ethylene glycol monoethyl ether) | 5.0 |
| Water | q.s. |

EXAMPLE III

| | |
|---|---|
| Hydrofluoric acid (100% basis) | 0.1 |
| $C_{14}$—$C_{15}$ alcohol ethoxylated with 11 mols ethylene oxide | 0.5 |
| White vinegar (20% acetic acid) | 1.0 |
| Isopropanol | 5.0 |
| Water | q.s. |

EXAMPLE IV

| | |
|---|---|
| Hydrofluoric acid (100% basis) | 0.3 |
| Sodium dodecylbenzene sulphonate | 0.10 |
| White vinegar (20% acetic acid) | 4.0 |
| Water | q.s. |

EXAMPLE V

| | |
|---|---|
| Hydrofluoric acid (100% basis) | 0.2 |
| Sodium lauryl ether sulphate (3 EtO) | 0.07 |
| White vinegar (20% acetic acid) | 5.0 |
| Water | q.s. |

EXAMPLE VI

| | |
|---|---|
| Hydrofluoric acid (100% basis) | 0.2 |
| Sodium dodecyl benzene sulphonate | 0.10 |
| Orthophosphoric acid (100% basis) | 0.2 |
| Butyl "Cellosolve" | 4.0 |
| Water | q.s. |

EXAMPLE VII

| | |
|---|---|
| Ammonium bifluoride | 0.35 |
| Sodium lauryl ether sulphate (3 EtO) | 0.05 |

-continued

| | |
|---|---|
| Sulphuric acid (100% basis) | 0.25 |
| Water | q.s. |

EXAMPLE VIII

| | |
|---|---|
| Ammonium bifluoride | 0.30 |
| Lactic acid (100% basis) | 0.25 |
| $C_9$—$C_{11}$ alcohol ethoxylated with 6 mols of ethylene oxide | 0.20 |
| Isopropanol | 5.0 |
| Water | q.s. |

In handling and transferring compositions containing hydrofluoric acid, it is, of course, necessary to keep it out of prolonged contact with glass and metal. It is convenient to employ containers made of, or lined with, organic resins such as epoxy, polyethylene or polypropylene.

When cleaning composition of the present invention are used to clean windows, mirrors, or the windscreens of automobiles which have been clouded by weathering and aging for a period of years, the original brilliance of the glass is restored. The cleaning compositions of the present invention are particularly effective for glass which is frequently sprayed with water. They can be used for regular maintenance or as an occasional renovating product.

We claim:

1. A composition suitable for cleaning articles of glass and glazed ceramic consisting essentially of 0.05% to 0.5% by weight of hydrofluoric acid or an acid salt thereof; a water-soluble acid selected from the group consisting of 0.02% to 4% by weight of an organic acid selected from the group consisting of acetic acid, hydroxyacetic acid, propionic acid and lactic acid and 0.05% to 0.8% by weight of a non-oxidizing mineral acid other than hydrofluoric acid having an equivalent weight greater than 20; 0.01% to 0.5% by weight of a water-soluble, organic, anionic or nonionic detergent; 0% to 10% by weight of a solvent selected from the group consisting of $C_1$–$C_4$ alkyl ethers of ethylene glycol, $C_1$–$C_4$ alcohols and $C_2$–$C_4$ ketones; and water.

2. A composition as claimed in claim 1 wherein said detergent is a nonionic detergent.

3. A composition as claimed in claim 1 which consists essentially of, by weight, from 0.1% to 0.3% of hydrofluoric acid or an acid salt thereof, from 0.1 to 1% of acetic acid, from 0.05% to 0.2% of said detergent, from 1% to 10% of said solvent, and the remainder water.

4. A composition as claimed in claim 1 wherein said detergent in an anionic detergent.

5. A composition as claimed in claim 4 wherein said detergent is sodium lauryl ether sulphate.

6. A composition as claimed in claim 1 wherein said water-soluble acid is said organic acid.

7. A composition as claimed in claim 6 wherein said organic acid is acetic acid.

8. A composition as claimed in claim 1 which consists essentially of, by weight, from 0.1% to 0.3% of hydrofluoric acid or an acid salt thereof, from 0.05% to 0.2% of said detergent, from 0.1% to 0.5% of said acid, from 1% to 10% of said solvent, and the remainder water.

9. A composition as claimed in claim 8 wherein said solvent is ethylene glycol monobutyl ether.

10. A composition as claimed in claim 8 which contains hydrofluoric acid.

11. A composition as claimed in claim 8 wherein said water-soluble acid is orthophosphoric acid or sulfuric acid.

* * * * *